US007269371B2

(12) United States Patent
Ahne

(10) Patent No.: US 7,269,371 B2
(45) Date of Patent: Sep. 11, 2007

(54) IMAGING APPARATUS HAVING INTERFACE DEVICE FOR PRINT MODE SELECTION

(75) Inventor: Adam Jude Ahne, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 322 days.

(21) Appl. No.: 10/865,300

(22) Filed: Jun. 10, 2004

(65) Prior Publication Data

US 2005/0276626 A1 Dec. 15, 2005

(51) Int. Cl.
*G03G 15/00* (2006.01)

(52) U.S. Cl. ..... 399/85; 399/81

(58) Field of Classification Search ..... 399/81, 399/82, 85, 396; 715/839, 846, 974, 977
See application file for complete search history.

(56) References Cited

U.S. PATENT DOCUMENTS

| | | | | | |
|---|---|---|---|---|---|
| 4,192,608 | A | * | 3/1980 | Goshima et al. | 355/51 |
| 4,516,939 | A | | 5/1985 | Crimmins, Jr. | |
| 4,866,486 | A | * | 9/1989 | Higashio et al. | 399/184 |
| 5,164,767 | A | * | 11/1992 | Suzuki | 399/81 |
| 5,217,312 | A | | 6/1993 | Ruhe et al. | |
| 5,659,341 | A | | 8/1997 | Kinas | |
| 5,810,492 | A | | 9/1998 | Akahane et al. | |
| 5,852,452 | A | | 12/1998 | Imai | |
| 5,933,180 | A | | 8/1999 | Ruckl et al. | |
| 5,975,666 | A | | 11/1999 | Kawaguchi | |
| 6,058,277 | A | * | 5/2000 | Streefkerk et al. | 399/81 |
| 6,161,917 | A | | 12/2000 | Igarashi et al. | |
| 6,394,598 | B1 | | 5/2002 | Kaiser | |
| 6,516,178 | B2 | * | 2/2003 | Fukushima | 399/376 |
| 6,575,568 | B1 | | 6/2003 | Hiramatsu et al. | |
| 2002/0033781 | A1 | | 3/2002 | Kang et al. | |
| 2002/0057302 | A1 | | 5/2002 | Shimomura et al. | |
| 2002/0180819 | A1 | | 12/2002 | Faken | |
| 2003/0030713 | A1 | | 2/2003 | Izuma | |
| 2003/0063169 | A1 | | 4/2003 | Silverbrook et al. | |

FOREIGN PATENT DOCUMENTS

| | | | | |
|---|---|---|---|---|
| JP | 58106576 | A | * | 6/1983 |
| JP | 59009671 | A | * | 1/1984 |
| JP | 59055445 | A | * | 3/1984 |
| JP | 59143175 | A | * | 8/1984 |
| JP | 62-142646 | | * | 6/1987 |
| JP | 62186280 | A | * | 8/1987 |
| JP | 04198960 | A | * | 7/1992 |
| JP | 2000321936 | A | * | 11/2000 |
| JP | 2003149999 | A | * | 5/2003 |
| JP | 2004040275 | A | * | 2/2004 |

* cited by examiner

*Primary Examiner*—Robert Beatty
(74) *Attorney, Agent, or Firm*—Taylor & Aust, P.C.

(57) ABSTRACT

An imaging apparatus includes a print engine operable in a plurality of print modes. An interface device is communicatively coupled to the print engine. The interface device includes a control lever having a plurality of positions. The plurality of positions corresponds to the plurality of print modes, wherein the control lever is manually manipulated to select a desired print mode of the plurality of print modes.

19 Claims, 4 Drawing Sheets

IMAGING APPARATUS HAVING INTERFACE DEVICE FOR PRINT MODE SELECTION

BACKGROUND OF THE INVENTION

1. Field of the Invention

The present invention relates to an imaging apparatus, and, more particularly, to an interface device for print mode selection in an imaging apparatus.

2. Description of the Related Art

An imaging apparatus includes a print engine for forming an image on a print medium, such as a sheet of paper. Such a print engine may be, for example, an ink jet print engine or an electrophotographic (EP) print engine. An ink jet print engine may include a reciprocating ink jet printhead carrier that forms an image on a print medium, such as a sheet of paper, transparency or fabric, by selectively ejecting ink from one or more ink jet printheads onto the print medium. An EP print engine may form a latent image on an intermediate substrate, such as a photoconductive drum, which in turn is developed with dry or liquid toner, and then the developed image is transferred to the print medium.

An imaging apparatus typically facilitates printing in a plurality of selectable print modes. Changes in print mode will often affect both printing quality and printing speed, e.g., throughput. For example, improvements in the printing quality of an ink jet printer are commonly realized in print modes providing better, best and photo quality by employing a technique commonly referred to as shingling, or interlaced printing, wherein consecutive printing swaths are made to overlap and only a portion of the ink drops for a given print line, i.e., raster, are applied to the print medium on a given pass of the printhead. In typical shingling methods, however, as printing quality increases, so does the number of passes of the printhead required to print the image data for a given raster, and thus the printing speed, in terms of printer throughput, typically decreases as printing quality increases.

In order for the user to select a print mode for printing an image, a user typically must navigate through a plurality of display screen prompts within their application and/or the printer driver in order to get to the proper screen to effect the selection. Also, sometimes a user may be confused as to how a particular change, for example a change affecting printing quality, will influence printing speed, in terms of throughput.

What is needed in the art is a simple to use and intuitive interface device for mode selection in an imaging apparatus.

SUMMARY OF THE INVENTION

The present invention provides a simple to use and intuitive interface device for mode selection in an imaging apparatus.

The present invention, in one form thereof, is directed to an imaging apparatus. The imaging apparatus includes a print engine operable in a plurality of print modes. An interface device is communicatively coupled to the print engine. The interface device includes a control lever having a plurality of positions. The plurality of positions corresponds to the plurality of print modes, wherein the control lever is manually manipulated to select a desired print mode of the plurality of print modes.

In another form thereof, the present invention is directed to an imaging apparatus. The imaging apparatus includes a print engine operable in a plurality of print modes. An interface device is communicatively coupled to the print engine. The interface device is manually manipulated to select a desired print mode of the plurality of print modes. An icon is provided that is indicative of at least one of the plurality of print modes.

An advantage of the present invention is that it may reduce, or avoid, the need of a user to navigate through a plurality of display screen prompts within their application and/or the printer driver in order to get to the proper screen to make a print mode, e.g., printing speed and/or printing quality, selection.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
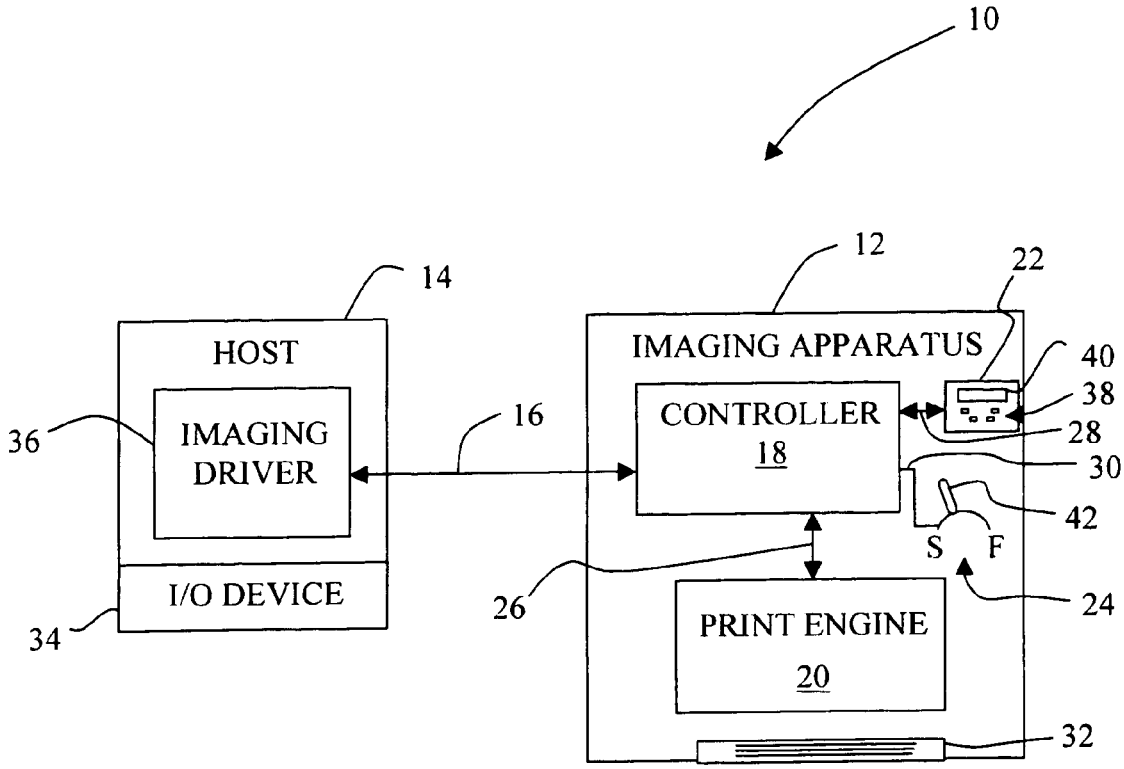
FIG. 1 is a diagrammatic representation of a system, including an imaging apparatus, employing an embodiment of the present invention.

Referring now to the drawings, and particularly to FIG. 1, there is shown a system 10 illustrating one embodiment the present invention. System 10 may include an imaging apparatus 12 and a host 14, with imaging apparatus 12 communicating with host 14 via a communications link 16. Alternatively, imaging apparatus 12 may be a standalone unit that is not communicatively linked to a host, such as host 14. For example, imaging apparatus 12 may take the form of a multifunction machine that includes standalone copying and facsimile capabilities, in addition to optionally serving as a printer when attached to a host, such as host 14.

Imaging apparatus 12 includes, for example, a controller 18, a print engine 20, a user interface 22, and a print mode interface device 24, such as for example, a control lever unit.

Controller 18 may include a processor unit and associated memory, and may be formed as an Application Specific Integrated Circuit (ASIC). Controller 18 communicates with print engine 20 via a communications link 26. Controller 18 communicates with user interface 22 via a communications link 28. Controller 18 communicates with print mode interface device 24 via a communications link 30.

Accordingly, print mode interface device 24 in effect is communicatively coupled to print engine 20 via controller 18 and communication links 26 and 30. Further, in embodiments that include host 14, which may execute printer driver software, print mode interface device 24 in effect is communicatively coupled to host 14 via controller 18 and communication links 16 and 30.

Communications link 16 may be established by a direct cable connection, wireless connection or by a network connection such as for example an Ethernet local area network (LAN). Each of communications links 26, 28 and 30 may be established, for example, by using one of a standard electrical cabling or bus structure, or by a wireless connection.

Print engine 20 is operable in a plurality of print modes, e.g., a plurality of printing speeds and/or printing qualities, as determined at least in part by the imaging data, and the format of the imaging data, received from controller 18, and a selection made by a user manipulation of print mode interface device 24.

Print engine 20 may be, for example, an ink jet print engine or an electrophotographic (EP) print engine. As is well known in the art, an ink jet print engine may include a reciprocating ink jet printhead carrier that forms an image on a print medium 32, such as a sheet of paper, transparency or fabric, by selectively ejecting ink from one or more ink jet printheads onto print medium 32. The ink jet printheads may be formed integral with an ink supply to form one or more unitary printhead cartridges, which are carried by the ink jet printhead carrier. Also, as is well known in the art, an EP print engine may form a latent image on an intermediate substrate, such as a photoconductive drum, which in turn is developed with dry or liquid toner, and then the developed image is transferred to print medium 32.

In embodiments of the invention which include host 14, host 14 may be, for example, a personal computer including an input/output (I/O) device 34, such as keyboard and display monitor. Host 14 also may include a processor, input/output (I/O) interfaces, memory, such as RAM, ROM, NVRAM, and a mass data storage device, such as a hard drive, CD-ROM and/or DVD units. During operation, host 14 may include in its memory a software program including program instructions that function as an imaging driver 36, e.g., printer driver software, for imaging apparatus 12. Imaging driver 36 is in communication with controller 18 of imaging apparatus 12 via communications link 16. Imaging driver 36 facilitates communication between imaging apparatus 12 and host 14, and may provide formatted print data, as determined by a selected print mode, to imaging apparatus 12, and more particularly, to print engine 20.

Alternatively, however, all or a portion of imaging driver 36 may be located in controller 18 of imaging apparatus 12. For example, where imaging apparatus 12 is a multifunction machine having standalone capabilities, controller 18 of imaging apparatus 12 may include an imaging driver configured to support a copying function, and/or a fax-print function, and may be further configured to support a printer function. In this embodiment, the imaging driver facilitates communication of formatted print data, as determined by a selected print mode, to print engine 20.

User interface 22 may include buttons 38 for receiving user input, such as for example, power on, or print media tray selection. User interface 22 may also include a display screen 40 for displaying information relating to imaging apparatus 12, such as for example, print job status information.

Print mode interface device 24 is provided on imaging apparatus 12 to allow a user to select a desired print mode from among a plurality of print modes, e.g., based on a desired printing speed and/or a printing quality, by positioning a control lever 42 in one of a plurality of positions, e.g., one of two or more positions. Printing quality may be characterized, for example, in terms of printing resolution, and in an ink jet printing environment, the number of printing passes used to print a print swath.

Such positions associated with control lever 42 may be defined in discrete increments. For example, the positions may be in discrete increments of printing speeds, in term of throughput, such as for example 2, 5, 10, 12, etc. pages per minute, or, in discrete increments of printing resolutions, such as for example, 600 dots per inch (dpi), 1200 dpi, 2400 dpi, 4800 dpi, etc. Alternatively, such positions may be represented by a continuous range of positions, e.g., a continuous range of printing speeds from a minimum printing speed to a maximum printing speed, or a continuous range of print resolutions.

Thus, in operation, control lever 42 is manually manipulated by a user to select a desired print mode of the plurality of print modes. Print mode interface device 24 communicates the position of control lever 42, via communications link 30, to controller 18, which in turn executes program instructions, which may be in firmware, to control the operation of print engine 20 according to the print mode selected by the user via control lever 42. In embodiments that include host 14, print mode interface device 24 communicates the position of control lever 42 to controller 18, and to host 14 via communications links 16, 30 and controller 18, which in turn execute program instructions, which may be in firmware, so as to control the operation of print engine 20 according to the print mode selected by the user via control lever 42.

Relative terms relating to the various print modes, e.g., relating to speed and/or print quality, of imaging apparatus 12 are used in describing the present invention. For example, the terms "slow relative printing speed" or "slower relative printing speed" are used to indicate that at least one other printing speed within imaging apparatus 12 exists that is faster. The terms "fast relative printing speed" or "faster relative printing speed" are used to indicate that at least one other printing speed within imaging apparatus 12 exists that is slower. Likewise, the term "relative increase in printing quality" is used to indicate that at least one other printing quality setting within imaging apparatus 12 exists that is of lesser printing quality. The term "relative reduction in printing quality" is used to indicate that at least one other printing quality setting within imaging apparatus 12 exists that has better printing quality.

In one embodiment of the present invention, print mode interface device 24 may include a simple two position switch, wherein control lever 42 is manually positioned at one of the two positions, e.g., slow (S) and fast (F), to select between two print modes, such as for example, a best printing quality that is associated with a slow relative printing speed and a draft printing quality that is associated with a fast relative printing speed.

Figure 2:
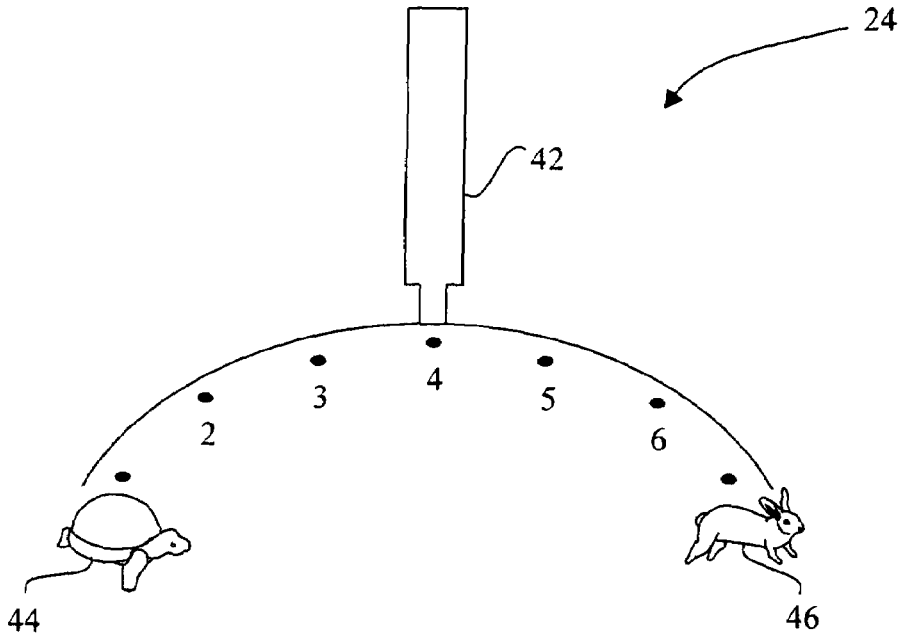
FIG. 2 is a diagrammatic representation of an embodiment of a print mode interface device of the imaging apparatus of FIG. 1.

FIG. 2 shows an embodiment of print mode interface device 24, wherein each position of the plurality of positions of control lever 42 has associated therewith an icon indicative of a corresponding print mode. In this embodiment, control lever 42 serves as a "throttle" control for imaging apparatus 12, e.g., a printing speed control. Print mode interface device 24 may include a resistive or capacitive bridge circuit, wherein a change in the position of control lever 42 will provide a proportional change in resistance or capacitance, which in turn can be correlated by controller 18 to a particular print mode, e.g., a printing quality and/or printing speed.

A shown in FIG. 2, with respect to the plurality of positions of control lever 42, a turtle icon 44 may be used to represent one extreme of the plurality of print modes, e.g., a photographic printing quality, wherein the best, i.e., highest, printing quality available from imaging apparatus 12 is provided, but in turn, at the slowest printing speed (e.g., the slowest throughput) of imaging apparatus 12. Where print engine 20 is an ink jet print engine, for example, the best printing quality is typically associated with a slow relative printing speed, e.g., the slowest printing speed, due to, for example, an increase in the number of printing passes of the printheads in order to complete the printing of an image on print medium 32. For example, for the best printing quality, controller 18 may select a shingling pattern of 16 passes, e.g., requiring 16 passes of the printhead over the same print line printed on print medium 32 to complete the printing of that particular print line. Thus, the relative printing speed in terms of throughput may be, for example, 5 pages per minute, or lower.

Also, as shown in FIG. 2, with respect to the plurality of positions of control lever 42, a rabbit icon 46 may be used to represent another extreme of the plurality of print modes, e.g., a draft printing quality, wherein the draft, e.g., lowest, printing quality available from imaging apparatus 12 is provided, but in turn, at the fastest printing speed (e.g., the fastest throughput) of imaging apparatus 12. Where print engine 20 is an ink jet print engine, for example, the draft printing quality is typically associated with a fast relative printing speed, e.g., the fastest printing speed, due to, for example, a minimum number of printing passes of each the printheads in order to complete the printing of an image on print medium 32. For example, for draft printing quality, controller 18 may select a shingling pattern of one pass, e.g., requiring a single pass of the printhead over a particular print line printed on print medium 32 to complete the printing of that particular print line. Thus, the relative printing speed in terms of throughput may be, for example, 12 pages per minute or higher.

As further shown in FIG. 2, numerals, e.g., 2, 3, 4, 5 and 6, may be used as indicators of relative printing speed, from a slower relative printing speed to a faster relative printing speed, between turtle icon 44 and rabbit icon 46. Alternatively, the turtle icon and the rabbit icon may be replaced with other icons, such as the word, SLOW, or character, S, to represent a slow relative printing speed, and the word, FAST, or character, F, to represent a fast relative printing speed. As a further alternative, it is contemplated that icons 44 and 46 may be in the form of a silhouette of a person to represent a photograph for a slowest printing speed, and an icon of a text document to indicate a faster printing speed.

Figure 3:
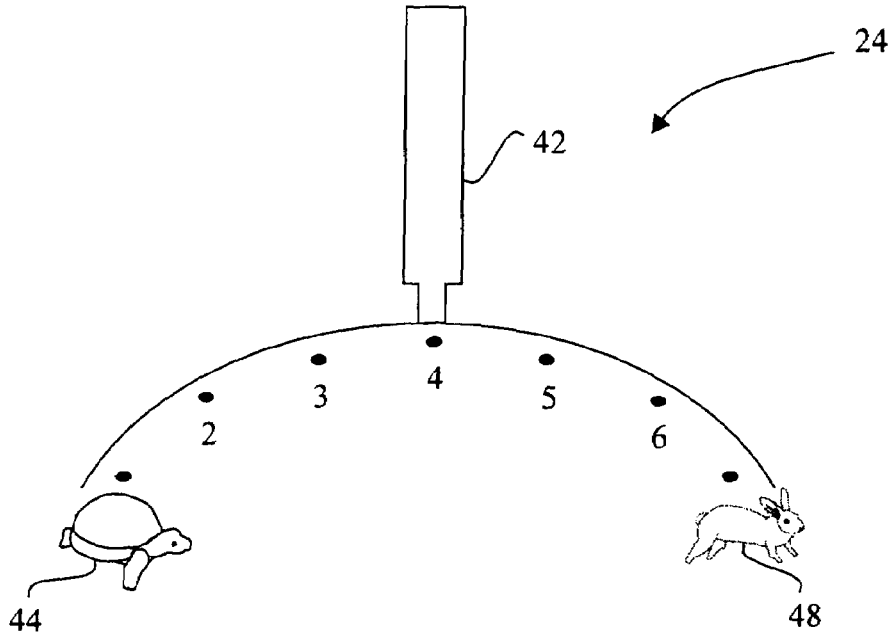
FIG. 3 is a diagrammatic representation of another embodiment of a print mode interface device of the imaging apparatus of FIG. 1.

FIG. 3 shows another embodiment of a print mode interface device, e.g., print mode interface device 24, wherein each position of the plurality of positions of control lever 42 has associated therewith a second rabbit icon 48 indicative of a corresponding print mode, as in FIG. 2, except in this embodiment rabbit icon 48 is intentionally made to appear out of focus, e.g., "fuzzy", to represent a faster relative printing speed of imaging apparatus 12, but also the relative reduction in printing quality of imaging apparatus 12 typically associated with a faster relative printing speed. In contrast, turtle icon 44 is intentionally made to appear in focus to represent a slower relative printing speed of imaging apparatus 12, and a relative increase in printing quality of imaging apparatus 12 typically associated with a slower relative printing speed.

Figure 4:
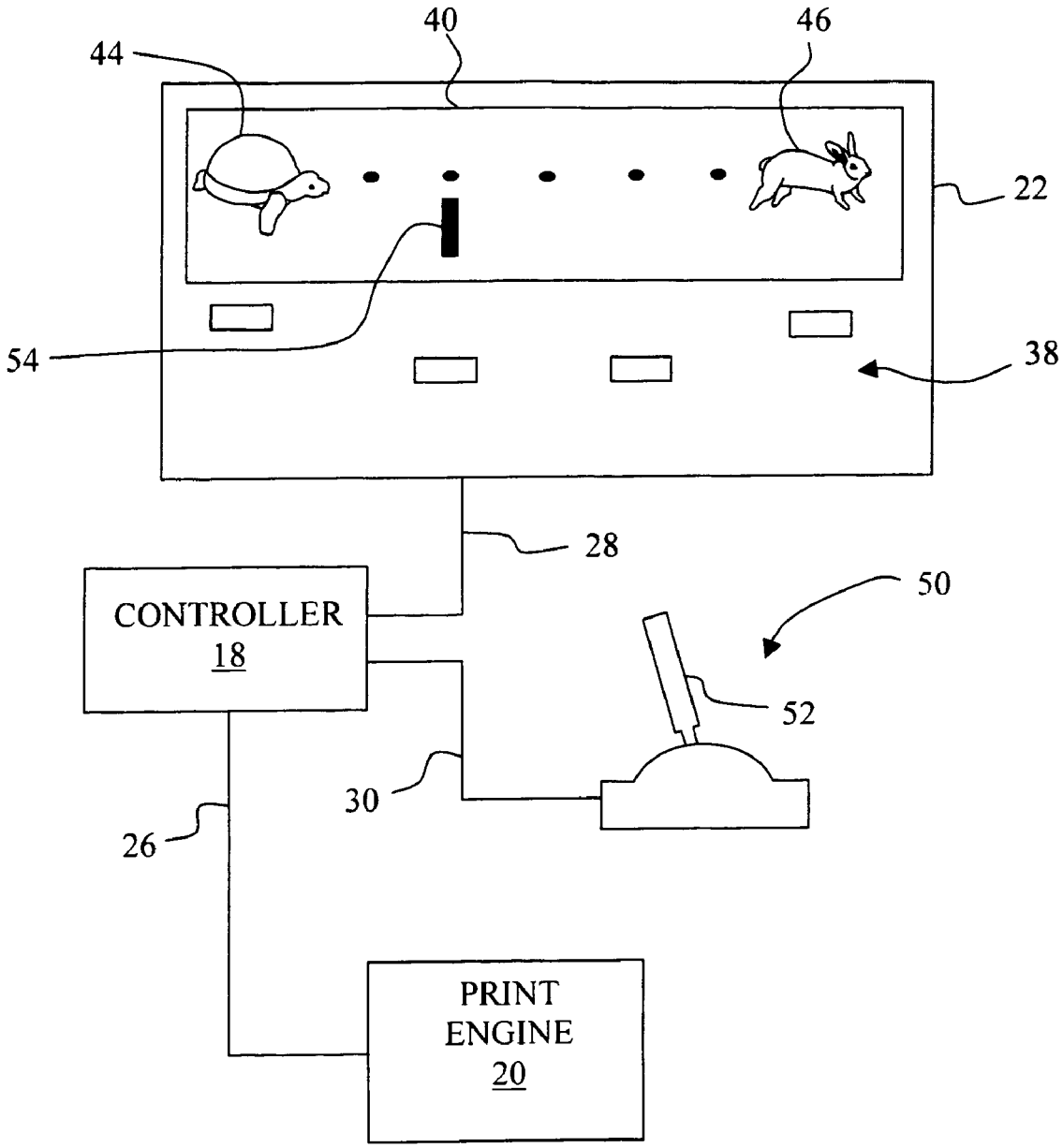
FIG. 4 is a diagrammatic representation of another embodiment of the present invention that utilizes the display screen of the user interface of the imaging apparatus of FIG. 1.

FIG. 4 shows another embodiment of the present invention, wherein a print mode interface device 50 is provided, communicatively coupled to controller 18 via communications link 30, and thus replaces print mode interface device 24 of FIG. 1. Print mode interface device 50 may be, for example, a joystick 52, e.g., a center return control lever. In this embodiment, joy stick 52 is used to effect a change in the print mode, e.g., printing quality and/or printing speed, and display screen 40 of user interface 22 displays the range of available print modes in terms of the icons, such as for example, turtle icon 44, rabbit icon 46 and/or rabbit icon 48, described above with respect to FIGS. 2 and 3. Of course, other icons may be substituted, if desired. As joystick 52 is moved, the position of a cursor 54 changes to indicate on display screen 40 the currently selected print mode, e.g., printing speed.

Figure 5:
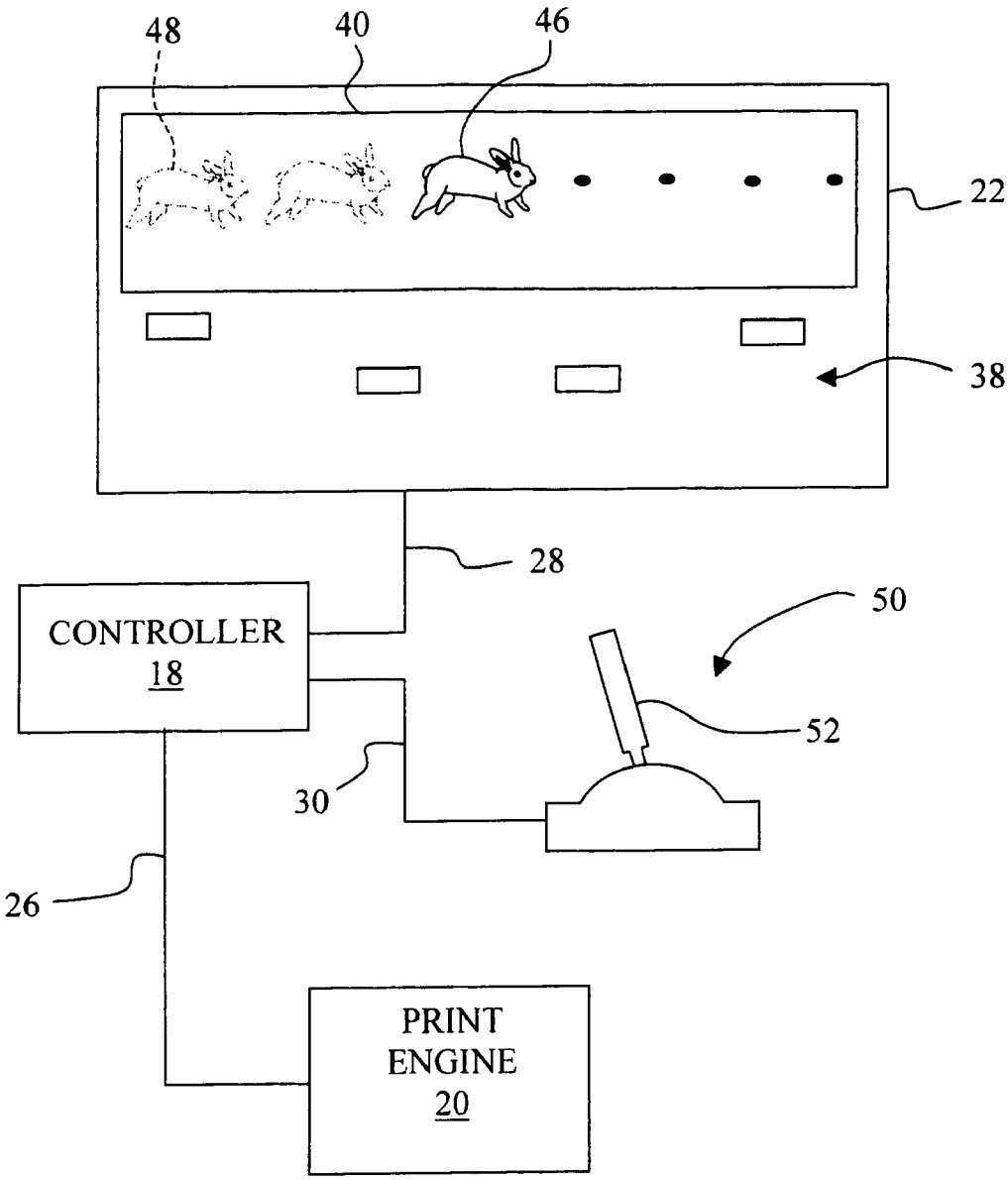
FIG. 5 is a diagrammatic representation of another embodiment of the present invention that utilizes the display screen of the user interface of the imaging apparatus of FIG. 1 to display an icon that moves across the display screen at an increasing rate of speed as the printing speed increases.

FIG. 5 shows an alternative embodiment to that of FIG. 4, wherein the rabbit icon, e.g., one of rabbit icons 46, 48 may move across display screen 40, e.g., from left to right, and may move at an increasing rate of speed as the printing speed increases, based on a movement of joystick 52, and may change for example from the in focus rabbit icon 46, as the printing speed is increased, to the out of focus rabbit icon 48.

In still another embodiment, based on the embodiments of FIGS. 4 and 5, for example, the function of joystick 52 may be performed by one or more of buttons 38 of user interface 22.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An imaging apparatus, comprising:

a print engine operable in a plurality of print modes; and an interface device communicatively coupled to said print engine, said interface device including a control lever having a plurality of positions, said plurality of positions corresponding to said plurality of print modes, wherein said control lever is manually manipulated to select a desired print mode of said plurality of print modes, wherein at least one of said plurality of positions has associated therewith an icon indicative of a corresponding printing speed.

2. The imaging apparatus of claim 1, wherein said icon is a turtle icon to represent a slow relative printing speed of said imaging apparatus.

3. The imaging apparatus of claim 2, wherein said turtle icon corresponds to a best printing quality available in said imaging apparatus.

4. The imaging apparatus of claim 1, wherein said icon is a rabbit icon to represent a fast relative printing speed of said imaging apparatus.

5. The imaging apparatus of claim 4, wherein said rabbit icon corresponds to a lowest printing quality available in said imaging apparatus.

6. The imaging apparatus of claim 4, wherein said rabbit icon corresponds to a draft printing quality.

7. The imaging apparatus of claim 1, wherein said icon is out of focus to represent a faster relative printing speed of said imaging apparatus, but also a relative reduction in printing quality of said imaging apparatus.

8. The imaging apparatus of claim 7, wherein said icon is a rabbit icon.

9. The imaging apparatus of claim 7, further comprising a turtle icon, said turtle icon being in focus to represent a slower relative printing speed of said imaging apparatus, and a relative increase in printing quality of said imaging apparatus.

10. An imaging apparatus, comprising:

a print engine operable in a plurality of print modes; and an interface device communicatively coupled to said print engine, said interface device including a control lever having a plurality of positions, said plurality of positions corresponding to said plurality of print modes, wherein said control lever is manually manipulated to select a desired print mode of said plurality of print modes, wherein at least one of said plurality of positions has associated therewith an icon indicative of a corresponding print mode, said icon being displayed on a display screen associated with said imaging apparatus; and wherein said icon moves across said display screen at an increased rate of speed as a printing speed of said imaging apparatus increases.

11. An imaging apparatus, comprising:

a print engine operable in a plurality of print modes; and an interface device communicatively coupled to said print engine, said interface device including a control lever having a plurality of positions, said plurality of positions corresponding to said plurality of print modes, wherein said control lever is manually manipulated to select a desired print mode of said plurality of print modes, wherein said plurality of positions represent discrete printing resolutions.

12. An imaging apparatus, comprising:

a print engine operable in a plurality of print modes;

an interface device communicatively coupled to said print engine, said interface device being manually manipulated to select a desired print mode of said plurality of print modes; and an icon indicative of at least one of said plurality of print modes, wherein said icon is a turtle icon to represent a slow relative printing speed of said imaging apparatus.

13. The imaging apparatus of claim 12, wherein said turtle icon corresponds to a best printing quality available in said imaging apparatus.

14. The imaging apparatus of claim 12, wherein said interface device is a control lever.

15. An imaging apparatus, comprising:

a print engine operable in a plurality of print modes;

an interface device communicatively coupled to said print engine, said interface device being manually manipulated to select a desired print mode of said plurality of print modes; and an icon indicative of at least one of said plurality of print modes, wherein said icon is a rabbit icon to represent a fast relative printing speed of said imaging apparatus.

16. The imaging apparatus of claim 15, wherein said rabbit icon corresponds to a draft printing quality.

17. An imaging apparatus, comprising:

a print engine operable in a plurality of print modes;

an interface device communicatively coupled to said print engine, said interface device being manually manipulated to select a desired print mode of said plurality of print modes; and an icon indicative of at least one of said plurality of print modes, wherein said icon is out of focus to represent a faster relative printing speed of said imaging apparatus, but also a relative reduction in printing quality of said imaging apparatus.

18. The imaging apparatus of claim 17, wherein said icon is a rabbit icon.

19. An imaging apparatus, comprising:

a print engine operable in a plurality of print modes;

an interface device communicatively coupled to said print engine, said interface device being manually manipulated to select a desired print mode of said plurality of print modes; and an icon indicative of at least one of said plurality of print modes, said icon being displayed on a display screen associated with said imaging apparatus, wherein said icon moves across said display screen at an increasing rate of speed as a printing speed increases.

* * * * *